United States Patent [19]

Inomata et al.

[11] Patent Number: 4,473,417

[45] Date of Patent: Sep. 25, 1984

[54] AMORPHOUS ALLOY FOR MAGNETIC CORE MATERIAL

[75] Inventors: Koichiro Inomata, Yokohama; Michio Hasegawa, Tokyo; Masakatsu Haga; Takao Sawa, both of Yokohama, all of Japan

[73] Assignee: Tokyo Shibaura Denki Kabushiki Kaisha, Kawasaka, Japan

[21] Appl. No.: 405,720

[22] Filed: Aug. 6, 1982

[30] Foreign Application Priority Data

Aug. 18, 1981 [JP] Japan ..... 56-128211

[51] Int. Cl.[3] ..... C22C 19/07

[52] U.S. Cl. ..... 148/403; 148/408; 148/425; 420/435; 420/436; 420/440; 428/606

[58] Field of Search ..... 148/403, 408, 425; 420/435, 436, 439, 440; 428/606

[56] References Cited

U.S. PATENT DOCUMENTS

| | | | |
|---|---|---|---|
| Re. 29989 | 5/1979 | Polk et al. | 148/403 |
| 3,838,365 | 9/1974 | Dutoit | 333/30 |
| 3,856,513 | 12/1974 | Chen et al. | 75/122 |
| 4,056,411 | 11/1977 | Chen et al. | 148/121 |
| 4,188,211 | 2/1980 | Yamaguchi | 75/170 |
| 4,302,515 | 11/1981 | DeCristofaro | 428/680 |
| 4,314,661 | 2/1982 | DeCristofaro | 228/263 |
| 4,365,994 | 12/1982 | Ray | 75/123 |

FOREIGN PATENT DOCUMENTS

| | | | |
|---|---|---|---|
| 0021101 | 5/1980 | Fed. Rep. of Germany . | |
| 3021536 | 12/1980 | Fed. Rep. of Germany . | |
| 53-60303 | 5/1978 | Japan | 148/403 |
| 57-19361 | 2/1982 | Japan | 148/403 |

*Primary Examiner*—John P. Sheehan

*Attorney, Agent, or Firm*—Schwartz, Jeffery, Schwaab, Mack, Blumenthal & Koch

[57] ABSTRACT

There is disclosed an amorphous alloy for a magnetic core material represented by the formula $$(Co_{1-x_1-x_2}Fe_{x_1}M_{x_2})_{x_3}B_{x_4}Si_{100-x_3-x_4}$$

wherein M is at least one element selected from the group consisting of Ti, V, Cr, Mn, Ni, Zr, Nb, Mo, Ru, Hf, Ta, W and Re, and $x_1$, $x_2$, $x_3$ and $x_4$ are numbers which satisfy relations of $0 \leqq x_1 \leqq 0.10$, $0 \leqq x_2 \leqq 0.10$, $70 \leqq x_3 \leqq 79$ and $5 \leqq x_4 \leqq 9$, respectively.

According to the present invention, it could be provided an amorphous alloy suitable for a magnetic core material of a magnetic amplifier in which its coercive force is as low as 0.4 oersted or less at a high frequency of 20 KHz or more, particularly even at 50 KHz, and its rectangular ratio is as much as 85% or more.

15 Claims, 4 Drawing Figures

AMORPHOUS ALLOY FOR MAGNETIC CORE MATERIAL

BACKGROUND OF THE INVENTION

The present invention relates to an amorphous alloy, more particularly to an amorphous alloy usuable as a magnetic core material for a magnetic amplifier or the like and having a low coercive force in a high frequency and excellent rectangular characteristics.

As a stabilized power source for the peripheral unit of a computer and a general communication device, in recent years, a switching power source carrying a magnetic amplifier has widely been used.

A main portion constituting a magnetic amplifier is a saturable reactor, and a magnetic core material excellent in rectangular magnetizing characteristics is now required for a core of the saturable reactor.

Heretofore, as such a magnetic core material, there has been used Sendelta (trade mark) comprising a Fe—Ni crystalline alloy.

However, being excellent in rectangular magnetinzing characteristics, Sendelta increases in coercive force in a high frequency of 20 KHz or more, whereby its eddy-current loss becomes great, so that it evolves heat and finally cannot be used any more. For this reason, in the case of a switching power source, the frequency has been limited to 20 KHz or less.

On the other hand, it is lately required to further heighten the switching frequency, along with demands for miniaturization and weight-saved of a switching power source, but a satisfactory magnetic core material having less coercive force at a high frequency and simultaneously having excellent reactangular characteristics has not been found yet until now.

SUMMARY OF THE INVENTION

The inventors of the present application have researched with much enthusiasm with the intention of overcoming such problems as mentioned above, and have finally found that when a cobalt series amorphous alloy is prepared under the requirements that boron and silicon are included in predetermined atomic parcentages and a crystallization temperature (Tx) is higher than a Curie temperature (Tc), the thus obtained amorphous alloy has a low coercive force in a high frequency of 20 KHz or more and is excellent in rectangular magnetizing characteristics. And, this finding has led to the completion of the present invention.

An object of the present invention is to provide an amorphous alloy suitable for a magnetic core material of a magnetic amplifier in which its coercive force (Hc) is as low as 0.4 oersted (Oe) or less at a high frequency of 20 KHz or more, particularly even at 50 KHz, and its rectangular ratio ($Br/B_1$) is as much as 85% or more.

This is to say, according to the present invention, there is provided an amorphous alloy for a magnetic core material represented by the formula $$(Co_{1-x1-x2}Fe_{x1}M_{x2})_{x3}B_{x4}Si_{100-x3-x4}$$

wherein M is at least one element selected from the group consisting of Ti, V, Cr, Mn, Ni, Zr, Nb, Mo, Ru, Hf, Ta, W and Re, and $x_1$, $x_2$, $x_3$ and $x_4$ are numbers which satisfy relations of $0 \leqq x_1 \leqq 0.10$, $0 \leqq x_2 \leqq 0.10$, $70 \leqq x_3 \leqq 79$ and $5 \leqq x_4 \leqq 9$, respectively.

DETAILED DESCRIPTION OF PREFERRED EMBODIMENTS

Hereinafter, the present invention is described more detail.

In the composition of the amorphous alloy according to the present invention, the component Fe contributes to the increase in the magnetic flux density of an alloy which will be obtained, and its component ratio $X_1$ is such that the relation of $0 \leqq x_1 \leqq 0.10$ is satisfied. It is undesirable that the ratio $x_1$ exceeds 0.10, because a magnetic strain of an alloy increases as a whole and thereby a coercive force (Hc) goes up.

The element M (one or more of Ti, V, Cr, Mn, Ni, Zr, Nb, Mo, Ru, Hf, Ta, W, and Re) is concerned in the thermal stability of an alloy, and its composition ratio $x_2$ is such that relation of $0 \leqq x_2 \leqq 0.10$ is satisfied. When the ratio $x_2$ exceeds 0.10, it will be hard to obtain an amorphous product. Of these elements represented by the element M, those which are highly effective and thus useful are Nb, Ta, Mo and Cr. The three above-mentioned components (Co, Fe and M) are determined so that the ratio $x_3$ of the total amount thereof may be in the relation of $70 \leqq x_3 \leqq 79$. In the case that the ratio $x_3$ is less than 70, it will be difficult to prepare a product in the amorphous form. On the other hand, when it exceeds 79, a crystallization temperature (tx) of an alloy will fall below a Curie temperature (Tc), and thereby as a whole it will be impossible to provide the alloy with a low-coercive force.

In the amorphous alloy according to the present invention, semi-metallic elements of B and Si are essential for the preparation of an amorphous product, and when the ratio $x_4$ of the component B is less than 5, it will be difficult to obtain an amorphous alloy. However, when it exceeds 9, a rectangular ratio of magnetic characteristics will be reduced. Accordingly, the ratio $x_4$ of the component B is to lie in the relation of $5 \leqq x_4 \leqq 9$.

The composition of the amorphous alloy of the present invention is preferred that the above-mentioned $x_1$, $x_2$, $x_3$ and $x_4$ are numbers which satisfy relations of $0.04 \leqq x_1 \leqq 0.07$, $0.01 \leqq x_2 \leqq 0.04$, $73 \leqq x_3 \leqq 77$ and $6.5 \leqq x_4 \leqq 9$, respectively.

Figure 1:
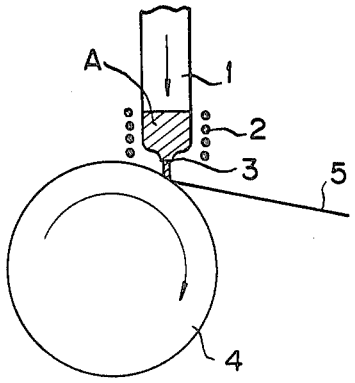
FIG. 1 shows a schematic view of an apparatus for preparing an amorphous alloy by using single roll method.

It is well known that an amorphous alloy can generally be prepared by quenching an alloy material including the respective components in predetermined ratios, from its molten state at a cooling rate of $10^5$° C./sec. or more (a liquid quenching method) (see, for example, IEEE Trans. Mag. MAG-12 (1976) No. 6, 921), thereby thin body is obtained having thickness of 10 to 50 μm. This quenching method can be carried out, for example, as shown in FIG. 1. In FIG. 1, starting alloy A is placed in a heating vessel 1 made of aluminum or quartz and fused under heating by using a high frequency heating furnace 2. The resultant molten alloy is ejected from a nozzle 3 which is mounted at the bottom of the heating vessel under gaseous pressure onto the surface of a roll 4 rotating at high speed (peripheral speed of 15 to 50 m/sec.), and then is drawn out as a thin body 5.

The amorphous alloy according to the present invention may be used in the form of a tape-like thin body which is prepared by an above-mentioned ordinary single roll method. In this case, it is usually preferred that a thin body has a thickness of 10 to 25 μm, since it is substantially difficult to prepare a thin body of 10 μm or less in a thickness by means of the quenching method.

In the following, the present invention will be explained on the basis of given Examples:

EXAMPLES 1-5

Thin bodies were prepared from amorphous alloys having a variety of compositions shown in Table 1 by use of an ordinary single roll method. Each thin body was about 5 mm in width and was 18 to 22 μm in thickness.

These strips of one meter in length were cut off from the thin bodies and were wound around bobbins of 20 mm in diameter in order to prepare toroidal cores. Afterward, each of the thus obtained cores was subjected to a heat treatment at a suitable temperature between a crystallization temperature (Tx) or less and a Curie temperature (Tc) or more, and then each sample was wholly dipped into water (25° C.) for quench.

Around each of the obtained cores a primary and a secondary winding were provided, and alternating hysteresis values were measured under an outer magnetic field of 1 Oe by use of an alternating magnetization measuring equipment. From curves of the obtained hysteresis values, coercive forces Hc and rectangular ratios $Br/B_1$ (Br and $B_1$ represent a residual magnetic flux density and a magnetic flux density in a magnetic field of 1 Oe, respectively) were evaluated. Table 1 exhibits the Hc and the $Br/B_1$ values of the thin bodies at each high frequency of 20 KHz, 50 KHz and 100 KHz. For comparison, corresponding values of conventional Sendelta is together shown therein.

TABLE 1

| | Composition | Coercive force Hc (Oe) | | | Rectangular ratio $Br/B_1$ (%) | | |
|---|---|---|---|---|---|---|---|
| | | 20 KHz | 50 KHz | 100 KHz | 20 KHz | 50 KHz | 100 KHz |
| Example 1 | $(Co_{0.94}Fe_{0.06})_{77}B_8Si_{15}$ | 0.185 | 0.250 | 0.275 | 90.0 | 91.5 | 95.5 |
| Example 2 | $(Co_{0.96}Fe_{0.04})_{77}B_8Si_{15}$ | 0.195 | 0.270 | 0.310 | 87.2 | 89.5 | 92.1 |
| Example 3 | $(Co_{0.92}Fe_{0.08})_{75}B_9Si_{16}$ | 0.210 | 0.290 | 0.330 | 86.5 | 88.5 | 90.5 |
| Example 4 | $(Co_{0.97}Nb_{0.03})_{77}B_8Si_{15}$ | 0.200 | 0.270 | 0.350 | 90.8 | 92.5 | 96.5 |
| Example 5 | $Co_{78}B_7Si_{15}$ | 0.210 | 0.280 | 0.315 | 87.1 | 88.7 | 90.6 |
| Comparative Example 1 | Sendelta | 0.92 | >1 | >1 | 98.0 | 99.0 | 99.0 |

As understood from Table 1, the amorphous alloys according to the present invention had Hc values of 0.4 Oe or less and $Br/b_1$ values of 85% or more. On the contrary, in regard to conventional Sendelta used, the $Br/B_1$ value was great but the Hc value was also disadvantageously great, and, above all, under the conditions of a high frequency of 50 KHz or more and an outer magnetic field of 1 Oe, measurement of Hc value was impossible.

This fact indicates that Sendelta is unsuitable as a magnetic core material at a high frequency.

EXAMPLES 6-10

Thin bodies were prepared from amorphous alloys represented by the formula $(Co_{0.92}Fe_{0.06}Nb_{0.02})_{77}B_x$-$Si_{23-x}$ in the same manner as in Examples 1-5 except that the amount of the component B was variously changed (i.e., the ratio x of the component B was altered), and for each of the resultant bodies, Hc and $Br/B_1$ values were measured. The results obtained are exhibited in FIG. 2, in which symbols o and • represent the Hc and $Br/B_1$ values, respectively.

Figure 2:
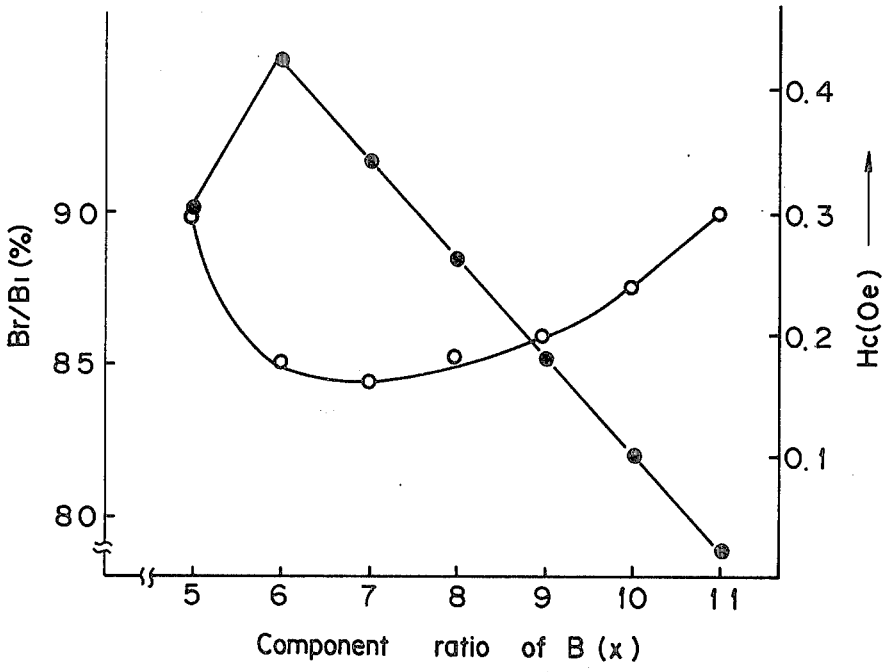
FIG. 2 shows relation curves between ratios x of the component B and rectangular ratios $Br/B_1$ as well as coercive forces Hc in regard to amorphous alloys of the composition $(Co_{0.92}Fe_{0.06}Nb_{0.02})_{77}B_xSi_{23-x}$ according to the present invention.

As is definite from FIG. 2, the sample having the ratios x of 5, 6, 7, 8 and 9 (Examples 6, 7, 8, 9 and 10) showed rectangular ratios $Br/B_1$ of 85% or more, at a frequency of 50 KHz but in the samples having the ratios x of 10 and 11 (Comparative examples 2 and 3), rectangular ratios were below 85%. The results suggest that the ratio x of the component B must be such that it satisfies the relation of $5 \leqq x \leqq 9$.

In this connection, samples having the ratios x of less than 5 took no amorphous state.

EXAMPLES 11-28

Thin bodies were prepared from amorphous alloys having compositions shown in Table 2 in which the component M is changed, by use of a single roll method. Each of the resultant thin bodies has a thickness of 18 to 22 μm.

Toriodal cores were prepared from these thin bodies in the same manner as in Examples 1-5, and around each of the prepared cores a primary and a secondary winding were provided. Then, alternating hysteresis values of the cores were measured under an outer magnetic field of 1 Oe by use of an alternating magnetization measuring equipment. From curves of the obtained hysteresis values, coercive forces Hc and rectangular ratios $Br/B_1$ were evaluated at a frequency of 50 KHz.

Further, these cores were subjected to an aging treatment in a constant temperature bath of 120° C. for 1000 hours, and then Hc and $Br/B_1$ values were measured again. The results obtained are shown in Table 2. For comparison, value of a sample not including any component M is together exhibited therein.

TABLE 2

| | Composition | Before aging | | After aging | |
|---|---|---|---|---|---|
| | | Hc (Oe) | $Br/B_1$ (%) | Hc (Oe) | $Br/B_1$ (%) |
| Example 11 | $(Co_{0.91}Fe_{0.06}Ti_{0.03})_{77}B_8Si_{15}$ | 0.23 | 93.0 | 0.25 | 92.5 |

TABLE 2-continued

| | Composition | Before aging Hc (0e) | Before aging Br/B1 (%) | After aging Hc (0e) | After aging Br/B1 (%) |
|---|---|---|---|---|---|
| Example 12 | $(Co_{0.91}Fe_{0.06}V_{0.03})_{77}B_8Si_{15}$ | 0.23 | 93.0 | 0.25 | 92.0 |
| Example 13 | $(Co_{0.91}Fe_{0.06}Cr_{0.03})_{77}B_8Si_{15}$ | 0.21 | 94.0 | 0.21 | 93.5 |
| Example 14 | $(Co_{0.91}Fe_{0.06}Mn_{0.03})_{77}B_8Si_{15}$ | 0.23 | 92.0 | 0.24 | 92.0 |
| Example 15 | $(Co_{0.91}Fe_{0.06}Ni_{0.03})_{77}B_8Si_{15}$ | 0.23 | 92.5 | 0.24 | 92.0 |
| Example 16 | $(Co_{0.91}Fe_{0.06}Zr_{0.03})_{77}B_8Si_{15}$ | 0.23 | 91.5 | 0.25 | 91.0 |
| Example 17 | $(Co_{0.91}Fe_{0.06}Nb_{0.03})_{77}B_8Si_{15}$ | 0.19 | 95.5 | 0.19 | 95.0 |
| Example 18 | $(Co_{0.91}Fe_{0.06}Mo_{0.03})_{77}B_8Si_{15}$ | 0.20 | 94.0 | 0.20 | 94.0 |
| Example 19 | $(Co_{0.91}Fe_{0.06}Ru_{0.03})_{77}B_8Si_{15}$ | 0.23 | 92.0 | 0.24 | 92.0 |
| Example 20 | $(Co_{0.91}Fe_{0.06}Hf_{0.03})_{77}B_8Si_{15}$ | 0.24 | 92.0 | 0.25 | 91.5 |
| Example 21 | $(Co_{0.91}Fe_{0.06}Ta_{0.03})_{77}B_8Si_{15}$ | 0.20 | 93.5 | 0.20 | 93.5 |
| Example 22 | $(Co_{0.91}Fe_{0.06}W_{0.03})_{77}B_8Si_{15}$ | 0.20 | 92.0 | 0.20 | 91.0 |
| Example 23 | $(Co_{0.91}Fe_{0.06}Re_{0.03})_{77}B_8Si_{15}$ | 0.24 | 91.0 | 0.26 | 90.0 |
| Example 24 | $(Co_{0.97}Ti_{0.03})_{77}B_8Si_{15}$ | 0.28 | 96.0 | 0.29 | 96.0 |
| Example 25 | $(Co_{0.97}Cr_{0.03})_{77}B_8Si_{15}$ | 0.26 | 94.0 | 0.27 | 94.0 |
| Example 26 | $(Co_{0.97}Nb_{0.03})_{77}B_8Si_{15}$ | 0.24 | 96.5 | 0.24 | 96.5 |
| Example 27 | $(Co_{0.97}Ru_{0.03})_{77}B_8Si_{15}$ | 0.25 | 96.0 | 0.25 | 95.5 |
| Example 28 | $(Co_{0.96}Mo_{0.02}Ta_{0.02})_{77}B_8Si_{15}$ | 0.26 | 96.0 | 0.27 | 96.0 |
| Comparative Example 4 | $(Co_{0.94}Fe_{0.06})_{77}B_{20}Si_3$ | 0.28 | 90.5 | 0.35 | 84.3 |

The results in Table 2 above indicate that the amorphous alloys according to the present invention (Examples 11 to 28) have low coercive forces, high rectangular characteristics and excellent thermal stabilities. Particularly, these effects are pronounced in the cases that the component M is Nb, Mo, Ta or Cr.

EXAMPLES 29–32

Figure 3:
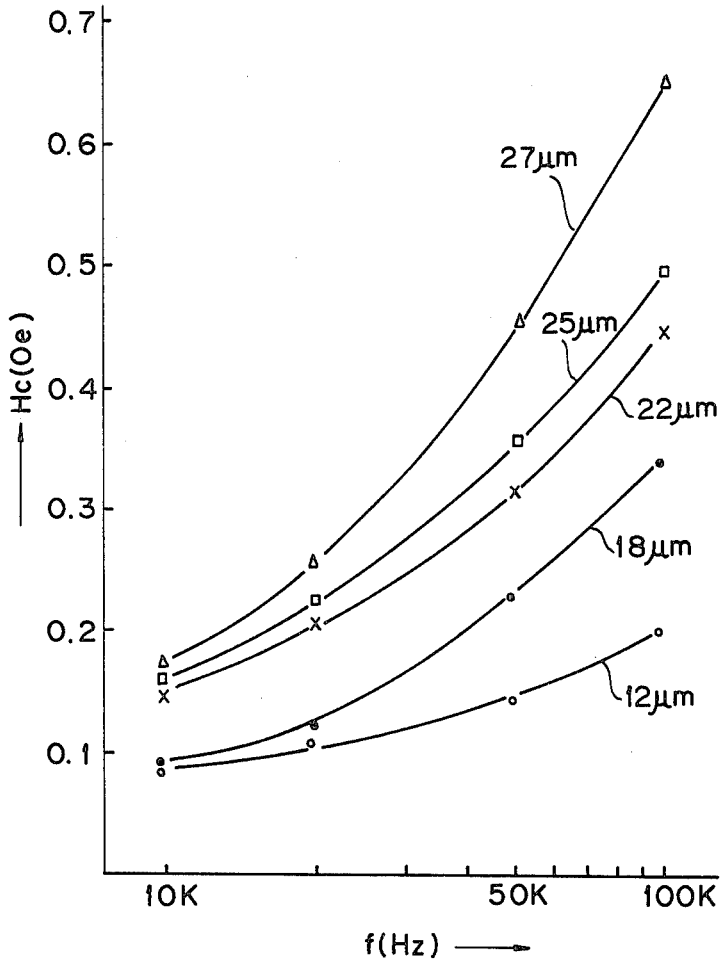
FIG. 3 shows relation curves between test frequencies f and coercive forces Hc of thin bodies, which are distinct in thickness, in regard to the amorphous alloy of the composition $(Co_{0.88}Fe_{0.06}Nb_{0.02}Ni_{0.04})_{76}B_9Si_{15}$ according to the present invention.

Thin bodies of 12 μm, 18 μm, 22 μm and 25 μm in thickness were prepared from amorphous alloys according to the present invention having the composition formula $$(Co_{0.86}Fe_{0.06}Nb_{0.02}Ni_{0.04})_{76}B_9Si_{15}$$

in a single roll method by changing a roll revolution number. For these bodies, coercive forces Hc were measured at a variety of high frequencies in the same way as in Examples 1–5, and obtained results are shown in FIG. 3. For comparison, thin body of 27 μm in thickness was prepared, and its result was also shown therein.

As FIG. 3 elucidates, samples of 12 μm, 18 μm, 22 μm and 25 μm in thickness (Examples 29, 30, 31 and 32) had as low Hc values as 0.4 Oe or less even at 50 KHz. On the other hand, as to a sample of 27 μm in thickness (Comparative example 5), the measured Hc value exceed 0.4 Oe at 50 KHz or more, which fact indicates that such a body is too thick and impractical for use as a magnetic core material.

EXAMPLE 33

A thin body of 16 μm in thickness was prepared from an amorphous alloy having the composition $$(Co_{0.90}Fe_{0.06}Cr_{0.04})_{77}B_8Si_{15}$$

and then a toroidal core was manufactured in the same manner as in Examples 1–5. The core was thermally treated at a temperature of 430° C. (Tc=500° C. and Tx=380° C.) and was then quenched in water.

Figure 4:
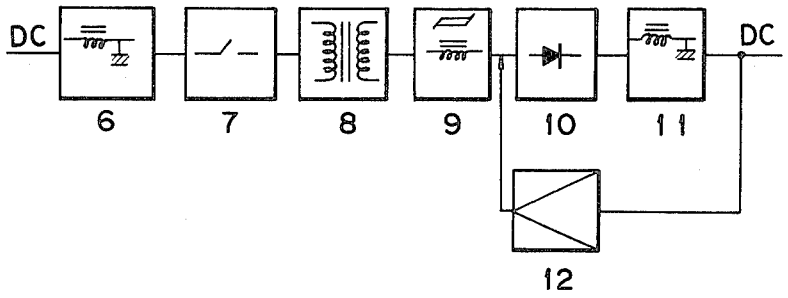
FIG. 4 shows a switching power source circuit including a magnetic amplifier in which there is used a saturable reactor comprising the amorphous alloy of the composition $(Co_{0.90}Fe_{0.06}Cr_{0.04})_{77}B_8Si_{15}$ according to the present invention.

The resultant core was utilized for a magnetic amplifier of the circuit shown in FIG. 4 in order to examine its performance as a switching power source for 100 KHz-operation. Measurement was made for efficiency (output/input×100(%)), temperature rise of the core (°C.) and exciting current (mA). Referring now to FIG. 4, reference numeral 6 is an input filter, 7 is a switch, 8 is a transformer, 9 is a magnetic amplifier, 10 is a rectifier, 11 is an output filter and 12 is a control zone. The results obtained in the above manner are exhibited in Table 3. For comparison, results according to the employment of Sendelta are also described therein.

TABLE 3

| | Composition | Efficiency (%) | Temperature rise of cores (°C.) | Exciting current (mA) |
|---|---|---|---|---|
| Example 33 | $(Co_{0.90}Fe_{0.06}Cr_{0.04})_{77}B_8Si_{15}$ | 80.2 | 38 | 80 |
| Comparative Example 6 | Sendelta | 70.0 | 85 | 740 |

As understood from Table 3, in the amorphous alloy according to the present invention, the efficiency improved about 10% more than Sendelta, the exciting current was as low as 1/9 of Sendelta, and the temperature rise of the core was also small. Therefore, it has been found that the amorphous alloy according to the present case is a highly excellent magnetic material.

In consequence, the amorphous alloy according to the present invention has as small a coercive force as 0.4 Oe or less in a high frequency and has as large a rectangular ratio of 85% or more, which fact means that the amorphous alloy according to the present invention is useful for a magnetic core of a magnetic amplifier or the like and is concluded to be greatly valuable in industrial fields.

We claim:

1. An amorphous alloy for a magnetic core material consisting essentially of the formula $$(Co_{1-x1-x2}Fe_{x1}M_{x2})_{x3}B_{x4}Si_{100-x3-xdi\,4}$$

wherein M is at least one element selected from the group consisting of Ti, V, Cr, Mn, Ni, Zr, Nb, Mo, Ru, Hf, Ta, W and Re, and $x_1$, $x_2$, $x_3$and $x_4$ are numbers which satisfy relations of $0 \leqq x_1 \leqq 0.10$, $0 \leqq x_2 \leqq 0.10$, $70 \leqq x_3 \leqq 79$ and $5 \leqq x_4 \leqq 9$, respectively, said amorphous alloy after aging having a rectangular ratio $Br/B_1$ of at least 85% at 50 KHz, wherein Br represents residual magnetic flux density and $B_1$ represents a magnetic flux density in magnetic field of 1 oersted.

2. An amorphous alloy according to claim 1, wherein $x_1$, $x_2$, $x_3$ and $x_4$ are numbers which satisfy relations of $0.4 \leqq x_1 \leqq 0.07$, $0.01 \leqq x_2 \leqq 0.04$, $73 \leqq x_3 \leqq 77$ and $6.5 \leqq x_4 \leqq 9$, respectively.

3. An amorphous alloy according to claim 1, wherein M is at least one selected from the group consisting of Nb, Ta, Mo and Cr.

4. An amorphous alloy according to claim 1, wherein said alloy is a thin body of 25 μm or less in thickness.

5. An amorphous alloy according to claim 4, wherein said alloy is a thin body of 10 to 25 μm in thickness.

6. An amorphous alloy for a magnetic core material consisting essentially of the formula $$(Co_{1-x1-x2}Fe_{x1}M_{x2})_{x3}B_{x4}Si_{100-x3-x4}$$

wherein M is at least one element selected from the group consisting of Ti, V, Mn, Ni, Zr, Nb, Mo, Ru, Hf, Ta, W and Re, and $x_1$, $x_2$, $x_3$ and $x_4$ are numbers which satisfy relations of $0 \leqq x_1 \leqq 0.10$, $0 \leqq x_2 \leqq 0.10$, $70 \leqq x_3 \leqq 79$ and $5 \leqq x_4 \leqq 9$, respectively.

7. An amorphous alloy according to claim 6, wherein $x_1$, $x_2$, $x_3$ and $x_4$ are numbers which satisfy relations of $0.04 \leqq x_1 \leqq 0.07$, $0.01 \leqq x_2 \leqq 0.04$, $73 \leqq x_3 \leqq 77$ and $6.5 \leqq x_4 \leqq 9$, respectively.

8. An amorphous alloy according to claim 6, wherein M is at least one element selected from the group consisting of Nb, Ta and Mo.

9. An amorphous alloy according to claim 6, wherein said alloy is a thin body of 25 m or less in thickness.

10. An amorphous alloy according to claim 9, wherein said alloy is a thin body of 10 to 25 m in thickness.

11. A toroidal core material comprising an amorphous alloy consisting essentially of the formula $$(Co_{1-x131\ x2}Fe_{x1}M_{x1})_{x3}B_{x4}Si_{100-x3x4}$$

wherein M is at least one element selected from the group consisting of Ti, V, Cr, Mn, Ni, Zr, Nb, Mo, Ru, Hf, Ta, W and Re, and $x_1$, $x_2$, $x_3$ and $x_4$ are numbers which satisfy relations of $0 \leqq x_1 \leqq 0.10$, $0 \leqq x_2 \leqq 0.10$, $70 \leqq x_3 \leqq 79$ and $5 \leqq x_4 \leqq 9$, respectively.

12. A toroidal core material according to claim 11, wherein $x_1$, $x_2$, $x_3$ and $x_4$ are numbers which satisfy relations of $0.04 \leqq x_1 \leqq 0.07$, $0.01 \leqq x_2 \leqq 0.04$, $73 \leqq x_3 \leqq 77$ and $6.5 \leqq x_4 \leqq 9$, respectively.

13. A toroidal core material according to claim 11, wherein M is at least one element selected from the group consisting of Nb, Ta, Mo and Cr.

14. A toroidal core material according to claim 11, wherein said alloy is a thin body of 25 m or less in thickness.

15. A toroidal core material according to claim 14, wherein said alloy is a thin body of 10 to 25 m in thickness.

* * * * *